US011600917B2

(12) United States Patent
Lee et al.

(10) Patent No.: US 11,600,917 B2
(45) Date of Patent: Mar. 7, 2023

(54) ANTENNA COVER ADAPTED TO MODIFY ANTENNA PATTERN

(71) Applicant: Alpha Networks Inc., Hsinchu (TW)

(72) Inventors: Yi Ju Lee, Hsinchu (TW); Ding-Bing Lin, Hsinchu (TW); Nien-Chih Tsai, Hsinchu (TW)

(73) Assignee: ALPHA NETWORKS INC., Hsinchu (TW)

( * ) Notice: Subject to any disclaimer, the term of this patent is extended or adjusted under 35 U.S.C. 154(b) by 40 days.

(21) Appl. No.: 17/400,571

(22) Filed: Aug. 12, 2021

(65) Prior Publication Data

US 2022/0294110 A1 Sep. 15, 2022

(30) Foreign Application Priority Data

Mar. 15, 2021 (TW) ..... 110109227

(51) Int. Cl.

| | |
|---|---|
| ***H01Q 1/42*** | (2006.01) |
| ***H01Q 3/01*** | (2006.01) |
| ***H01Q 15/02*** | (2006.01) |
| ***H01Q 1/32*** | (2006.01) |

(52) U.S. Cl.

CPC ..... *H01Q 3/01* (2013.01); *H01Q 1/32* (2013.01)

(58) Field of Classification Search

CPC .. H01Q 1/32; H01Q 1/38; H01Q 1/42; H01Q 3/01; H01Q 15/02; H01Q 15/08; H01Q 21/00

See application file for complete search history.

(56) References Cited

U.S. PATENT DOCUMENTS

| | | | | |
|---|---|---|---|---|
| 3,413,637 | A * | 11/1968 | Goebels, Jr. ..... | H01Q 15/02 343/756 |
| 5,929,819 | A * | 7/1999 | Grinberg ..... | H01Q 3/14 343/753 |
| 8,587,496 | B1 | 11/2013 | Peters | |
| 2005/0057402 | A1 | 3/2005 | Ohno et al. | |
| 2005/0062673 | A1 | 3/2005 | Wu et al. | |
| 2008/0238810 | A1 | 10/2008 | Winsor | |

(Continued)

FOREIGN PATENT DOCUMENTS

| | | |
|---|---|---|
| CN | 102723540 | 10/2012 |
| CN | 102790288 | 11/2012 |

(Continued)

OTHER PUBLICATIONS

TW OA dated Oct. 7, 2021.

(Continued)

*Primary Examiner* — Tho G Phan
(74) *Attorney, Agent, or Firm* — WPAT, PC

(57) ABSTRACT

An antenna cover is used with an antenna for passing therethrough a radiation of the antenna in order to modify an antenna pattern of the antenna. The antenna cover includes a housing having a first surface and a second surface; and a plurality of through holes penetrating through the housing and extending from the first surface to the second surface. By way of adjusting distances between the plurality of through holes and/or adjusting sizes of the plurality of through holes, the antenna cover functions to adjust the radiation of the antenna from a first antenna pattern to a second antenna pattern.

12 Claims, 5 Drawing Sheets

(56) References Cited

U.S. PATENT DOCUMENTS

| | | | | |
|---|---|---|---|---|
| 2013/0162491 | A1* | 6/2013 | Yu | H01Q 19/30 343/819 |
| 2015/0070243 | A1 | 3/2015 | Kish et al. | |
| 2018/0115083 | A1 | 4/2018 | Besoli et al. | |
| 2019/0036213 | A1 | 1/2019 | Russell et al. | |
| 2020/0212590 | A1 | 7/2020 | Rofougaran et al. | |
| 2020/0412022 | A1 | 12/2020 | Yun et al. | |

FOREIGN PATENT DOCUMENTS

| | | | | | |
|---|---|---|---|---|---|
| CN | 104037505 | | | 9/2014 | |
| CN | 110190377 | A | * | 8/2019 | |
| CN | 112350055 | A | * | 2/2021 | H01Q 1/288 |
| CN | 113644433 | A | * | 11/2021 | |
| CN | 113675605 | B | * | 9/2022 | |
| EP | 1976062 | A1 | * | 10/2008 | H01Q 15/02 |
| JP | 2014179876 | | | 9/2014 | |
| TW | 200512981 | | | 4/2005 | |
| WO | 2021003113 | | | 1/2021 | |
| WO | WO-2021088637 | A1 | * | 5/2021 | H01Q 1/36 |

OTHER PUBLICATIONS

TW OA dated Jun. 27, 2022.
TW OA dated Oct. 27, 2022.
Marc Imbert, et al., "Design and performance evaluation of a dielectric flat lens antenna for millimeter-wave applications." IEEE Antennas and Wireless Propagation Letters 2014 pp. 342-345.
JP OA dated Oct. 25, 2022.

* cited by examiner

ANTENNA COVER ADAPTED TO MODIFY ANTENNA PATTERN

FIELD OF THE INVENTION

The present invention relates to modification of an antenna pattern, and more particularly to an antenna cover adapted to modify an antenna pattern of an antenna.

BACKGROUND OF THE INVENTION

In consideration of driving safety, it is essential to install a radar on the side of the vehicle to detect obstacles. A popular one of the small and medium-sized radar antennas suitable to be installed on the vehicle side is a block array antenna, which consists of specifically allocated traditional patch antennas. Since it is hard to arbitrarily adjust a detection range of a block array antenna, radar signals received by a signal receiver might include signals reflected by ground or the vehicle itself, particularly when the block array antenna is installed at a lower position of the vehicle near ground and when a relatively large field of view of the block array antenna. As a result, the energy received by the signal receiver would be improperly increased.

In order to solve the problem caused by the relatively large field of view, the prior art uses a lot of additional patch antennas to concentrate the resulting radiation pattern. However, the additional antennas consume additional resources and occupy additional space so as to adversely make the radar bulky and make the design complicated.

SUMMARY OF THE INVENTION

In order to solve the above-mentioned problems, the present invention provides an antenna cover that adjusts the antenna pattern. One of the purposes of the antenna cover is to make the radiation pattern of the antenna change after passing through the antenna cover. By using the antennas with such antenna covers, the additional patch antennas for adjusting the antenna pattern would not be required or the number thereof could be reduced.

In an aspect, the present invention provides an antenna cover for adjusting an antenna pattern of an antenna. The antenna cover shields the antenna while changing a pattern of an antenna radiation passing therethough from a first antenna pattern to a second antenna pattern. The antenna cover includes a housing having a first surface and a second surface; and a plurality of through holes penetrating through the housing and extending from the first surface to the second surface. By way of adjusting distances between the plurality of through holes and/or adjusting sizes of the plurality of through holes, the antenna cover functions to adjust the radiation of the antenna from the first antenna pattern to the second antenna pattern.

BRIEF DESCRIPTION OF THE DRAWINGS

The invention will become more readily apparent to those ordinarily skilled in the art after reviewing the following detailed description and accompanying drawings, in which.

DETAILED DESCRIPTION OF PREFERRED EMBODIMENTS

The invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
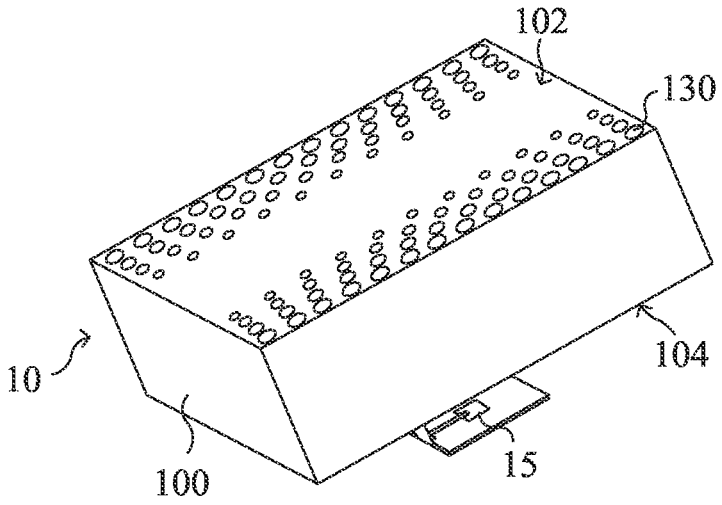
FIG. 1 is a schematic diagram illustrating an antenna cover according to an embodiment of the present invention.

Please refer to FIG. 1, which is a schematic diagram illustrating relative positions of an antenna cover and an antenna covered thereby according to an embodiment of the present invention. As shown, the antenna cover 10 covers a radiation-emitting side of the antenna 15 so that most of the electromagnetic waves radiated by the antenna 15 can pass through the antenna cover 10. A housing 100 of the antenna cover 10, for example, can be made of a material whose dielectric constant is greater than 1, e.g. PBT (Polybutylene Terephthalate) plastic. Furthermore, a plurality of through holes 130 are formed in the housing 100 of the antenna cover 10. The through holes 130 penetrate through the housing 100 and extend from a first surface 102 of the housing 100 to an opposite second surface 104 of the housing 100, which faces the antenna 15.

Based on the principle of electromagnetic waves, different dielectric constants will affect the radiation direction of the resulting electric field. Therefore, when the antenna pattern formed by the electromagnetic wave radiated by the antenna 15 is to be focused on a certain position, it is desirable to design the antenna cover 10 to make a specified portion of the antenna cover, which is closer to a focused area of the antenna cover 10, have the greatest dielectric constant. The dielectric constant of any other area of the antenna cover 10 is getting smaller as a distance from the focused area is getting longer. By formulating gaps among the through holes or dimensions of the through holes, the present invention can change the antenna pattern of the radiation emitted from the antenna 15 and passing through the antenna cover 10 according to practical requirements.

Figure 2A:
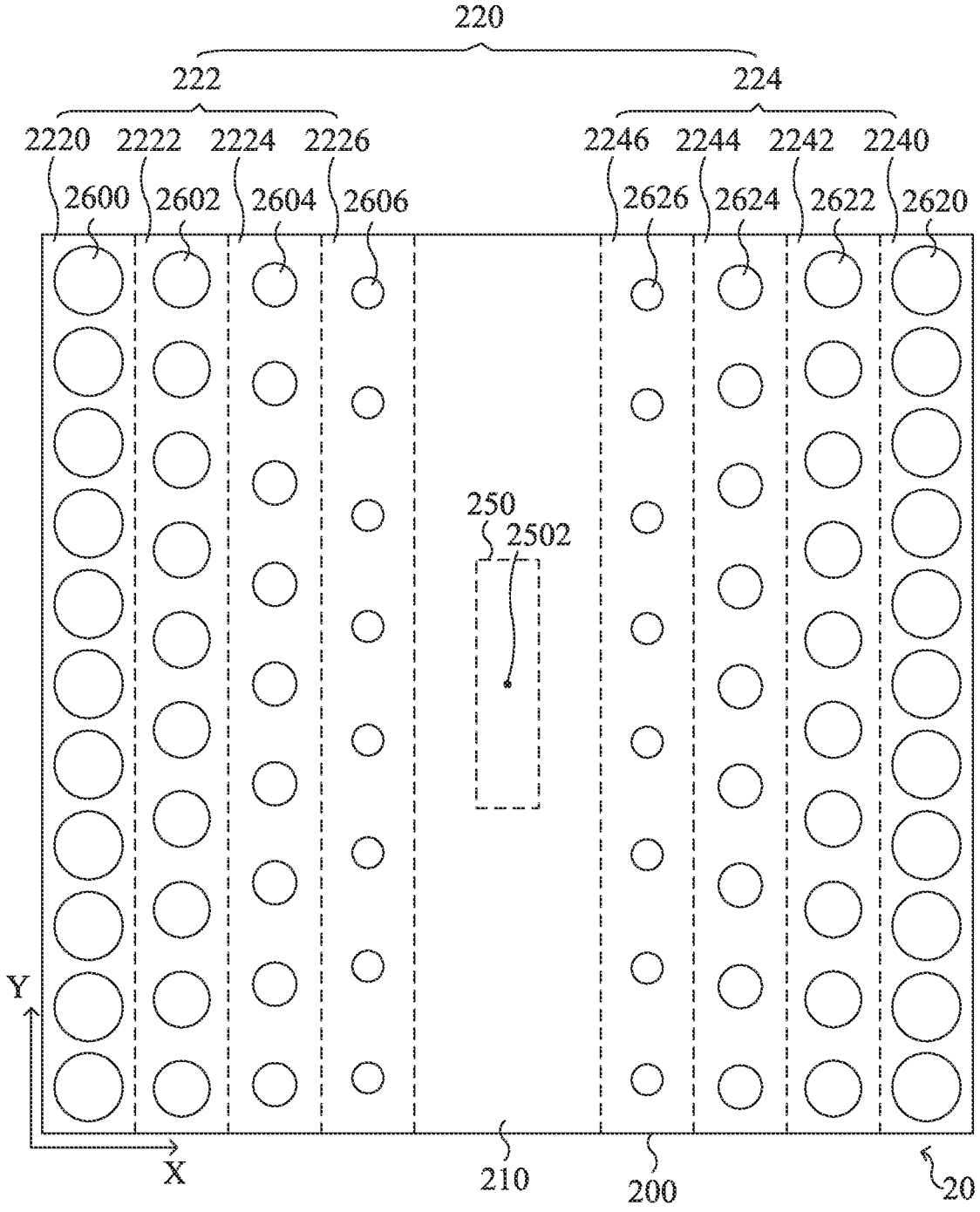
FIG. 2A is a top view of an antenna cover according to an embodiment of the present invention.

Please refer to FIG. 2A, which is a top view of an antenna cover according to an embodiment of the present invention. As shown, a housing 200 of the antenna cover has a central area 250, and the central area 250 has a central projection position 2502, where a center of the antenna is supposed to be projected. In order to make the adjusted antenna pattern more focused on the central area 250 than the original antenna pattern, i.e. make the projection position of the center of the antenna closer to the central projection position 2502, the central area 250 of the housing 200 is designed to have a greater dielectric constant than all the other area of the housing 200. Meanwhile, the sizes and positions of the through holes penetrating through the housing 200 are specifically designed to make the distribution of dielectric constants over the housing 200 decreasing toward the edges of the housing 200.

In order to make the antenna pattern focus near the center line of the antenna after passing through the antenna cover 20, the surface of the housing 200 is virtually divided into a plurality of areas, including: a non-porous area 210, which surrounds the central area 250, and a perforated area 220. No through hole is created in the non-porous area 210 so that the dielectric constant of the housing 200 in the non-porous area 210 can be the greatest in the entire antenna cover 20, and substantially kept the same as that of the original material.

Next to the non-porous area 210, a perforated area 220 is disposed, wherein the perforated area 220 includes a first perforated sub-area 222 and a second perforated sub-area 224 located on opposite sides of the non-porous area 210, respectively, and isolated by the non-porous area 210. The first perforated sub-area 222 includes through-hole block columns 2220, 2222, 2224 and 2226, and the second perforated sub-area 224 includes through-hole block columns 2240, 2242, 2244 and 2246. These through-hole block columns 2220-2226 and 2240-2246 respectively extend along a first direction, e.g. Y-axis, wherein the through-hole block columns 2220-2226 extend along a second direction, e.g. X-axis, in the first perforated sub-area 222, and the through-hole block columns 2240-2246 extend along the second direction, e.g. X-axis, in the second perforated sub-area 224.

It is understood that air is a medium having a very small dielectric constant close to vacuum. Therefore, according to the present invention, such a feature is utilized to adjust distribution of dielectric constants over the housing of the antenna cover. Since the housing 200 are created with through holes in the through-hole block columns 2220, 2222, 2224 and 2226, the average dielectric constant of each of the through-hole block columns is determined by a solid body of the housing 200 and air in the through holes in that through-hole block column. For example, the average dielectric constant of the through-hole block column 2220 is determined by the body of the housing 200 in the through hole block column 2220 and air in the through holes 2600; the average dielectric constant of the through-hole block column 2222 is determined by the body of the housing 200 in the through-hole block column 2222 and air in the through holes 2602; the average dielectric constant of the through-hole block column 2224 is determined by the body of the housing 200 in the through-hole block column 2224 and air in the through holes 2604; and the average dielectric constant of the through-hole block column 2226 is determined by the body of the housing 200 in the through-hole block column 2226 and air in the through holes 2606. As mentioned above, it is preferred according to the present invention that the dielectric constants over the housing 200 decrease toward the edges of the housing 200. Therefore, the average dielectric constant of the non-porous area 210 is made the highest; the through-hole block column 2226 is made lower than that of the non-porous area 210; the through-hole block column 2224 is made lower than that of the through-hole block column 2226; the average dielectric constant of the through-hole block column 2222 is made lower than that of the through-hole block column 2224; and the average dielectric constant of the through-hole block column 2220 is made lower than that of the through-hole block column 2222. Accordingly, a better focusing effect of electromagnetic wave can be achieved.

Based on practical requirements, what the average dielectric constant of each of the through-hole block columns 2220-2226 should be is first determined, and then how much area each of the through-hole block columns 2220-2226 should occupy is determined according to wavelength of the electromagnetic wave and focal length. Afterwards, how the through holes are created in respective through-hole block columns 2220-2226 is determined, e.g., the area ratios of the through holes in respective through-hole block columns 2220-2226 are determined, according to the occupied area and average dielectric constant.

Figure 2B:
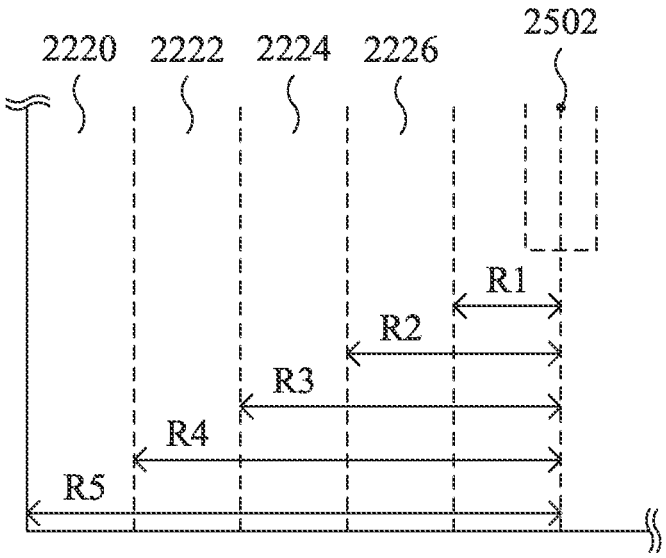
FIG. 2B is a scheme illustrating a first perforated sub-area of the housing of the antenna cover as illustrated in FIG. 1.

In the left portion of the housing 200 as shown in FIG. 2B, i.e. the first perforated sub-area 222, a vertical distance between a right boundary of the through-hole block column 2226 and the central projection position 2502 of the antenna is R1; a vertical distance between a right boundary of the through-hole block column 2224 and the central projection position 2502 of the antenna is R2; a vertical distance between a right boundary of the through-hole block column 2222 and the central projection position 2502 of the antenna is R3; and a vertical distance between a right boundary of the through-hole block column 2220 and the central projection position 2502 of the antenna is R4. Meanwhile, a vertical distance between the central projection position 2502 of the antenna and a left boundary of the housing 200 is R5. Each of the through-hole block columns 2220-2226 has its own optimal volume ratio of physical part to through holes, which is determined according to the required average dielectric constant. Assuming the thickness of the housing 200 is uniform in all regions of the through-hole block columns 2220-2226, the volume ratios can be presented by way of area ratios of the through-hole block columns 2220-2226 instead. An area ratio of a through-hole block column is defined to be overall surface area of the physical part to overall opening area of the through holes in the through-hole block column. Furthermore, on the conditions that the through holes in the same through-hole block column are of the same sizes and distributed evenly, the volume ratio in the through-hole block column can be presented by way of a ratio of the size of the through holes to the size of the physical part instead.

Figure 2C:
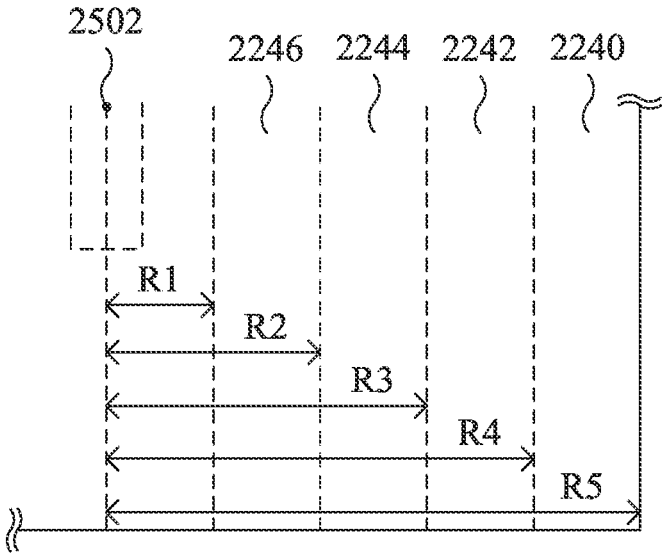
FIG. 2C is a scheme illustrating a second perforated sub-area of the housing of the antenna cover as illustrated in FIG. 1.

Likewise, in the right portion of the housing 200 as shown in FIG. 2C, i.e. the second perforated sub-area 224, a vertical distance between a left boundary of the through-hole block column 2246 and the central projection position 2502 of the antenna is R1; a vertical distance between a left boundary of the through-hole block column 2244 and the central projection position 2502 of the antenna is R2; a vertical distance between a left boundary of the through-hole block column 2242 and the central projection position 2502 of the antenna is R3; and a vertical distance between a left boundary of the through-hole block column 2240 and the central projection position 2502 of the antenna is R4. Meanwhile, a vertical distance between the central projection position 2502 of the antenna and a right boundary of the housing 200 is R5. The sizes of through-hole block columns and respective through holes created in the second perforated sub-area 224, as well as the distances between adjacent through holes, may also be made symmetric to the first perforated sub-area 222.

In this embodiment, the requirement on decreasing dielectric constants with distances from the central projection position 2502 according to the present invention is fulfilled by increasing sizes of through holes. Alternatively, it is also feasible to adjust dielectric constants by decreasing intervals between through holes or increasing numbers of through holes from the center toward the edges of the housing 200. Of course, the above-mentioned parameters such as sizes, intervals and numbers, or any additional ones, may be combined together to design the antenna cover. It is understood by those skilled in the art that the more significant the dielectric constant decreases, the more prominent the effect of focusing electromagnetic waves would be. Therefore, according to the present invention, the focusing effect can be optimized by properly patterning the through-hole block columns and allocating the through holes.

For example, in the embodiment of the first perforated sub-area 222 illustrated in FIG. 2B, the size of each the through hole 2600 in the through hole block column 2220 is greater than the size of each the through hole 2602 in the through hole block column 2222, and meanwhile, the distance between two adjacent through holes 2600 in the through hole block column 2220 is shorter than the distance between two adjacent through holes 2602 in the through hole block column 2222. Therefore, a difference in average dielectric constants between the through hole block column 2220 and the through hole block column 2222 becomes more significant. Likewise, for achieving a more prominent focusing effect, it is desirable that the size of each the through hole 2602 in the through hole block column 2222 is greater than the size of each the through hole 2604 in the through hole block column 2224, and meanwhile, the distance between two adjacent through holes 2602 in the through hole block column 2222 is shorter than the distance between two adjacent through holes 2604 in the through hole block column 2224; and the size of each the through hole 2604 in the through hole block column 2224 is greater than the size of each the through hole 2606 in the through hole block column 2226, and meanwhile, the distance between two adjacent through holes 2604 in the through hole block column 2224 is shorter than the distance between two adjacent through holes 2606 in the through hole block column 2226. Similar discussion can be applied to the embodiment of the second perforated sub-area 224 illustrated in FIG. 2C. That is, the size of each the through hole 2620 in the through hole block column 2240 is greater than the size of each the through hole 2622 in the through hole block column 2242, and meanwhile, the distance between two adjacent through holes 2620 in the through hole block column 2240 is shorter than the distance between two adjacent through holes 2622 in the through hole block column 2242; the size of each the through hole 2622 in the through hole block column 2242 is greater than the size of each the through hole 2624 in the through hole block column 2244, and meanwhile, the distance between two adjacent through holes 2622 in the through hole block column 2242 is shorter than the distance between two adjacent through holes 2624 in the through hole block column 2244; and the size of each the through hole 2624 in the through hole block column 2244 is greater than the size of each the through hole 2626 in the through hole block column 2246, and meanwhile, the distance between two adjacent through holes 2624 in the through hole block column 2244 is shorter than the distance between two adjacent through holes 2626 in the through hole block column 2246.

Furthermore, in order to keep the effect of a through-hole block column on the antenna pattern as consistent as possible, the sizes of all the through holes in the same through-hole block column are made of the same size and evenly distributed. Taking the through-hole block column 2220 in the first perforated sub-area 222 as an example, eleven through holes 2600 of the same size are uniformly formed, and the center points of the eleven through holes 2600 are allocated in the same straight line. The other through-hole block columns in this embodiment are configured in similar ways. Of course, in some cases where the antenna pattern is not critical, e.g. a common car-side radar, the through holes may also be configured in a non-uniform manner. Furthermore, the through holes in different through-hole block columns 2222-2226 may be configured in different manners. For example, some are configured with the same sizes, some are configured with even distribution, and some are configured without specifically considering the same sizes or even distribution. Similar discussion may apply to the second perforated sub-area 224.

Figure 3A:
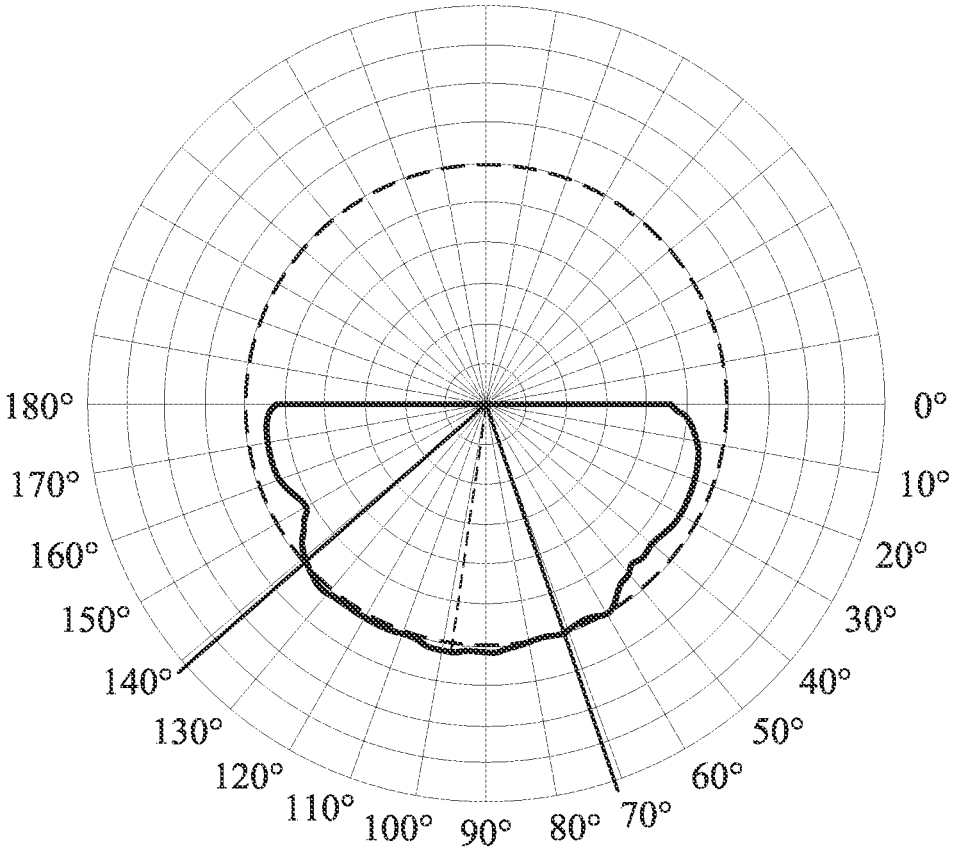
FIG. 3A is a scheme illustrating an antenna pattern of an antenna without an antenna cover.
Figure 3B:
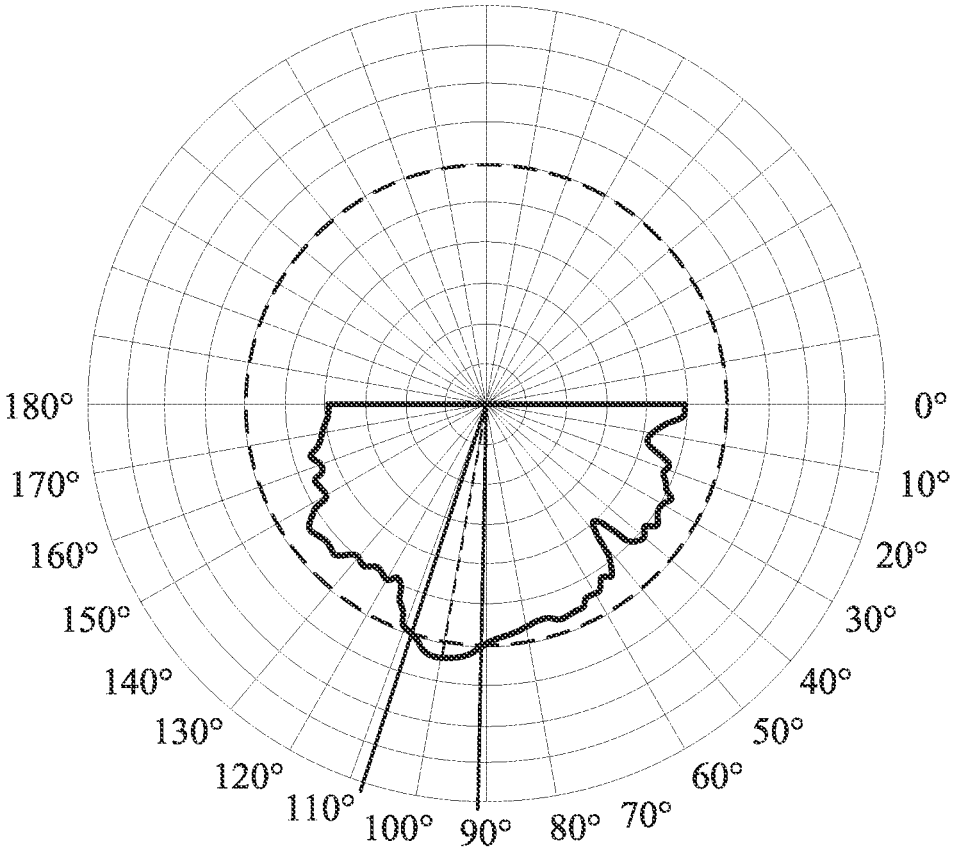
FIG. 3B is a scheme illustrating an antenna pattern of an antenna with an antenna cover according to an embodiment of the present invention.

Next, please refer to FIGS. 3A and 3B. FIG. 3A is a scheme illustrating an antenna pattern of an antenna without an antenna cover provided by the present invention, and FIG. 3B is a scheme illustrating a modified antenna pattern of the antenna shown in FIG. 3A and shielded with an antenna cover according to the present invention, e.g. the one illustrated in FIGS. 2A, 2B and 2C. Table 1 exemplifies dimensions of physical parts and through holes of the through-hole block columns 2222-2226 in the first perforated sub-area 222, and similar discussion may also apply to the second perforated sub-area 224. In Table 1, Layer 1 refers to the area between the antenna center projection position 2502 and the right boundary of the through-hole block column 2226; Layer 2 refers to the area of the through-hole block column 2226; Layer 3 refers to the area of the through-hole block column 2224; Layer 4 refers to the area of the block column 2222; and Layer 5 refers to the area of the through-hole block column 2220. Furthermore, Ri refers to the aforementioned vertical distances in the ith layer, Si refers to the distances between the center points of adjacent through holes in the ith layer, and di refers to the radii of the through holes in the ith layer, where i=1-5.

TABLE 1

| | Layer 1 | Layer 2 | Layer 3 | Layer 4 | Layer 5 |
|---|---|---|---|---|---|
| Ri | 2.86 mm | 4.23 mm | 5.54 mm | 6.68 mm | 7.85 mm |
| Si | 0 | 1.59 mm | 1.46 mm | 1.35 mm | 1.25 mm |
| di | 0 | 0.5 mm | 0.64 mm | 0.75 mm | 0.86 mm |

It can be seen from Table 1 that in this embodiment, the distance (Si) between adjacent through holes in a layer is getting smaller while the size (Di) of each through hole is getting greater when the layer is closer to the left or right edge of the antenna cover, i.e. the vertical distance (Ri) of the layer from the central projection position of the antenna cover. In the resulting antenna cover, the closer a layer to the left or right edge of the antenna cover, the more rapidly the space occupied by through holes increases. The effect of the configuration on the antenna pattern of the antenna can be realized by comparing FIGS. 3A and 3B.

It can be seen from the antenna patterns shown in FIGS. 3A and 3B that without the antenna cover, the maximal radiation is measured at a point in a 100-degree orientation of the antenna pattern. The maximal radiation is −37.3 db, and the Half-Power Beamwidth (HPBW) is approximately 66 degrees wide, i.e. between about 72 degrees and about 138 degrees. On the other hand, with the antenna cover according to the present invention, the maximal radiation is also measured at a point in a 100-degree orientation of the antenna pattern. However, the maximal radiation increases to −35.6 db, and the Half-Power Beamwidth (HPBW) is more focused to approximately 15 degrees wide, i.e. between about 92.5 degrees and about 107.5 degrees. It is clear that the antenna cover can indeed effectively enhance the focusing effect of the antenna.

In summary, the antenna cover designed according to the present invention can modify the antenna pattern by properly creating and allocating through holes in manners as described and exemplified above to adjust the average dielectric constants in different area of its housing. Therefore, no additional antenna as used in the prior art is required. Instead, the antenna pattern can be modified by providing an antenna cover with a configuration designed according to the present invention to overcome the defects of the prior art.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An antenna cover adapted to pass therethrough a radiation of an antenna for modifying an antenna pattern of the antenna, comprising:

a housing having a first surface and a second surface; and a plurality of through holes penetrating through the housing and extending from the first surface to the second surface, wherein by way of adjusting distances between the plurality of through holes and/or adjusting sizes of the plurality of through holes, the antenna cover functions to adjust the radiation of the antenna from a first antenna pattern to a second antenna pattern.

2. The antenna cover according to claim 1, wherein the first surface of the housing includes a non-porous area and a perforated area, and the plurality of through holes are distributed in the perforated area with the specific distribution pattern and the specific sizes.

3. The antenna cover according to claim 2, wherein the perforated area includes a first perforated sub-area consisting of a plurality of through-hole block columns, which are allocated side by side and extend from a margin of the non-porous area toward an edge of the housing.

4. The antenna cover according to claim 3, wherein the perforated area further includes a second perforated sub-area consisting of a plurality of through-hole block columns, which are allocated side by side and extend from another margin of the non-porous area toward an edge of the housing, and the through holes in each of the plurality of through-hole block columns in the first perforated sub-area are of the same size, and the through holes in different ones of the plurality of through-hole block columns in the second perforated sub-area are of different sizes.

5. The antenna cover according to claim 4, wherein the perforated area includes a second perforated sub-area separated from the first perforated sub-area with the non-porous area, and consisting of a plurality of through-hole block columns, which are allocated side by side and extend from another margin of the non-porous area toward another edge of the housing.

6. The antenna cover according to claim 5, wherein the through holes in each of the plurality of through-hole block columns in the second perforated sub-area are of the same size, and the through holes in different ones of the plurality of through-hole block columns in the second perforated sub-area are of different sizes.

7. The antenna cover according to claim 6, wherein the size of the through holes in one of the plurality of through-hole block columns in the second perforated sub-area, which is closer to the another edge of the housing, is greater than the size of the through holes in any other one of the plurality of through-hole block columns in the second perforated sub-area, which is closer to the non-porous area.

8. The antenna cover according to claim 7, wherein the size of the through holes in one of the plurality of through-hole block columns in the first perforated sub-area, which is closer to the another edge of the housing, is greater than the size of the through holes in any other one of the plurality of through-hole block columns in the first perforated sub-area, which is closer to the non-porous area.

9. The antenna cover according to claim 5, wherein the through holes in the same one of the plurality of through-hole block columns in the second perforated sub-area are linearly aligned with one another.

10. The antenna cover according to claim 9, wherein the through holes in the same one of the plurality of through-hole block columns in the first perforated sub-area are linearly aligned with one another.

11. The antenna cover according to claim 5, wherein the housing has a central projection position in the non-porous area, where a center of the antenna is projected, and respective vertical distances from the plurality of through-hole block columns in the second perforated sub-area to the central projection position are different.

12. The antenna cover according to claim 11, wherein respective vertical distances from the plurality of through-hole block columns in the first perforated sub-area to the central projection position are different.

* * * * *